United States Patent [19]

Van Horn

[11] 4,090,507

[45] May 23, 1978

[54] HYDROTHERAPY TANK

[76] Inventor: Frederick M. Van Horn, 3414 NE. 143rd Ave., Vancouver, Wash. 98662

[21] Appl. No.: 778,073

[22] Filed: Mar. 16, 1977

[51] Int. Cl.[2] ..... A61H 9/00

[52] U.S. Cl. ..... 128/66; 4/182

[58] Field of Search ..... 128/66, 370, 369; 4/182, 178

[56] References Cited

U.S. PATENT DOCUMENTS

| | | | |
|---|---|---|---|
| 847,324 | 3/1907 | Ely | 128/370 |
| 2,272,481 | 2/1942 | Rinkes et al. | 128/66 |
| 2,730,104 | 1/1956 | Newman | 128/370 |
| 3,827,087 | 8/1974 | Cuthbertson | 4/178 |

*Primary Examiner*—Lawrence W. Trapp
*Attorney, Agent, or Firm*—Chernoff & Vilhauer

[57] ABSTRACT

A hydrotherapy tank has a sloped bottom for elevating the extremities of a user's limbs improving the blood circulation therein. Fluid introduced into the tank bottom by a pump, through an inlet aperture which is located between the limbs near their extremities, expands outwardly over the top surfaces of the limbs, and an outlet aperture connected to the suction side of the pump and located in the bottom of the tank between the limbs away from their extremities, draws the fluid back downwardly over the outside surface of the legs and out of the tank. A heater connected to the pump warms the fluid as it is circulated. Thus the heated fluid is spiraled upwardly around the limbs away from their extremities further improving blood circulation. In a variation of the invention a deflector is located in the tank between the limbs above the inlet aperture for deflecting fluid entering the tank sideways against the inner surfaces of the limbs.

5 Claims, 3 Drawing Figures

HYDROTHERAPY TANK

BACKGROUND OF THE INVENTION

This invention relates to a hydrotherapy tank. In particular it relates to a hydrotherapy tank where fluid is spiraled around the user's limbs while being drawn away from their extremities.

Hydrotherapy tanks wherein a fluid is circulated continuously past limbs which are supported in a heated bath are well known in the prior art for treatment of certain pathological conditions of the limbs. However, in the prior art devices the fluid movement is used as a general massage in aiding blood circulation. Therefore the fluid is not circulated about the limbs in a manner which directly aids flow of venous blood towards the heart. In addition with the prior art hydrotherapy tanks the user's limbs generally are disposed horizontally which again does not improve venous blood flow.

SUMMARY OF THE INVENTION

In its basic concept, the hydrotherapy tank of this invention comprises firstly a sloped bottom surface for elevating the extremeties of limbs placed in the tank, and secondly fluid circulation means adapted for circulating the fluid in a sprial flow pattern around the limbs and away from their extremities, both intended for improving blood circulation in the limbs, thereby overcoming the aforementioned disadvantages of prior art devices.

It is an object of the present invention to provide such a tank wherein the fluid alternately can be directed outwardly into contact with the side surfaces of the limbs.

It is a further object of the present invention to provide such a tank which has pads for locating the limbs comfortably within the tank.

The foregoing and other objects, features, and advantages of the principal invention will be more readily understood upon consideration of the following detailed description taken in conjunction with the accompanying drawings.

DETAILED DESCRIPTION OF A PREFERRED EMBODIMENT

Figure 1:
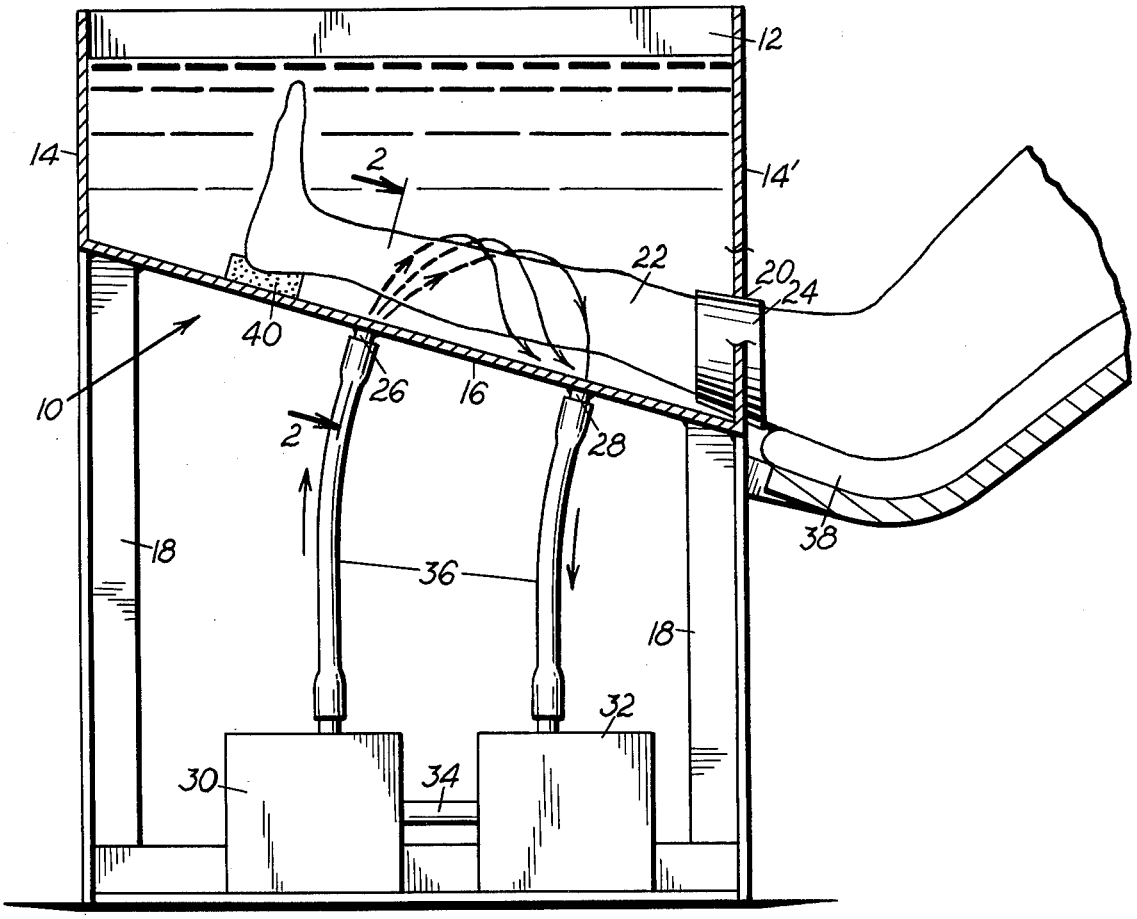
FIG. 1 is a side elevation, partially in section, showing a preferred embodiment of the hydrotherapy tank of the present invention.

Referring the FIG. 1 of the drawings the hydrotherapy tank of the present invention comprises a tank shell 10 having opposed sidewalls 12 and opposed end walls 14 interconnected by a bottom 16 with the joints between the tank elements being formed in a manner for holding fluid within the tank. The bottom is sloped between the end walls at a shallow angle, making one of the end walls shorter than the other. In the embodiment illustrated the tank shell is supported in a raised position by a box frame 18.

Located in the longer end wall 14' are paired generally circular openings 20, each adapted for receiving one of a user's limbs, such as leg 22. The openings are located side by side in the lower margin of the end wall adjacent to the bottom and sealing means, such as flexible rubber sleeves 24 are located in the openings and are attached peripherally to end wall 14'. The sleeves are dimensioned for fitting snugly over the user's legs thereby forming a seal which prevents fluid from leaking out of the tank shelf.

Located in the tank bottom between legs 22, near their extremities, is an inlet aperture 26 comprised of a circular opening into which a short segment of rigid tubing is inserted and sealed. Also located in the tank bottom between the legs is a like configured outlet aperture 28; however, the output aperture is located lower in the bottom than the inlet aperture, peferrably near the inner end of sleeves 24.

Fluid from the tank is circulated between outlet aperture 28 and inlet aperture 26 by circulation means, such as a pump 30. A fluid heater for heating the circulating fluid is connected to the pump by line 34 and flexible tubing 36 interconnects pump 30 to inlet aperture 26 and heater 32 to outlet aperture 28 for completing the circulation network. Appropriate controls (not shown) and wiring (not shown) supply power to the pump and heater for their operation.

Leg rests 38 are located on frame 18 for supporting the user's legs, and foot pads 40 are joined to the upper end of bottom 16 for supporting his heels.

Figure 3:
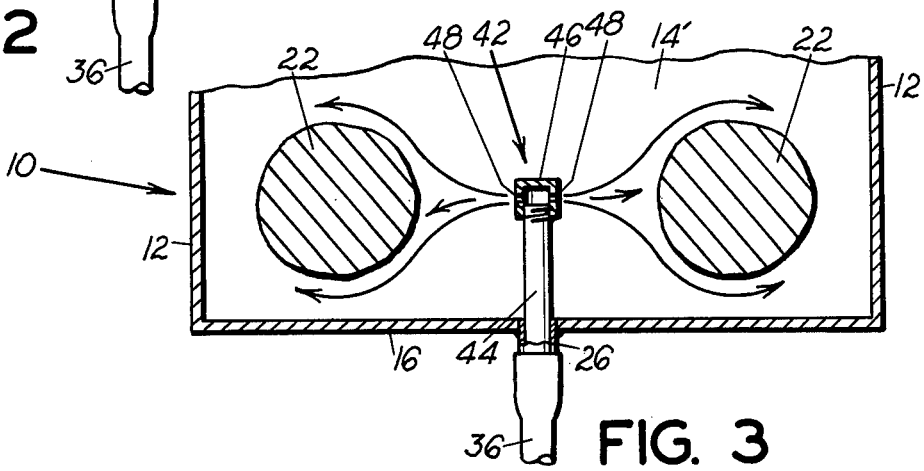
FIG. 3 is a sectional view of another embodiment of the invention taken along the same line as FIG. 2.

A variation of the invention, FIG. 3, employs a deflector 42 which is located in the tank shell between the user's legs above the inlet aperture, for directing the fluid outwardly against the sides of the legs. In the embodiment illustrated the deflector includes a stand pipe 44, which fits into the inlet aperture and has a cap 46 attached to its end which defines a plurality of openings 48 for directing the water sideways toward each leg.

In operation tank shell 10 is filled with fluid, which preferably is preheated, by conventional means. If the fluid is not preheated, pump 30 and heater 32 must be operated prior to use of the tank to heat the fluid. When the fluid is warm the user sits in a chair (not shown) and inserts his legs 22 into the tank shell through sleeves 24 with the extremities of the legs being elevated due to the angle of bottom 16.

Figure 2:
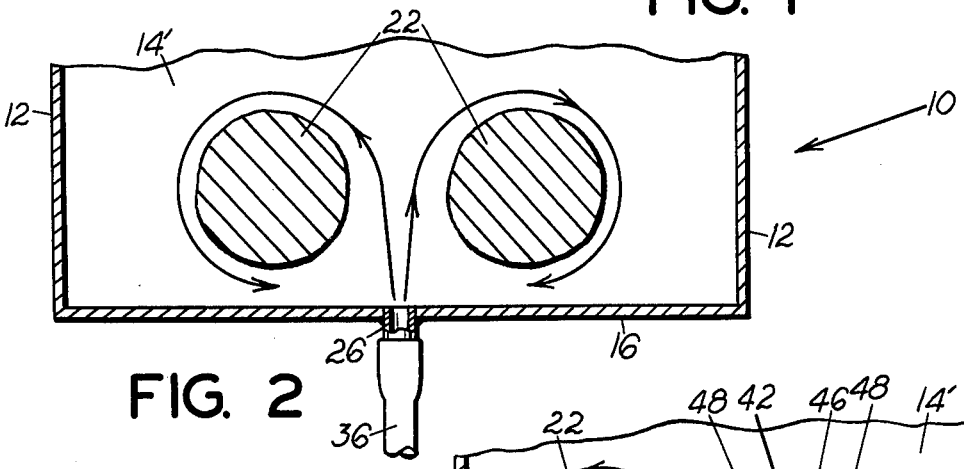
FIG. 2 is a sectional view taken along the lines 2—2 of FIG. 1.

The fluid then is circulated and kept warm by activating pump 30 and heater 32 thereby injecting the fluid into the tank between the user's legs and forcing it upwardly along the inner sides of the legs FIG. 2. As the fluid passes the legs it spreads outwardly over their upper surfaces where it is pulled longitudinally along the legs away from their extremities (to the right in FIG. 1) by the suction of outlet aperture 28. Once the fluid passes over the tops of the legs it is pulled downwardly by the suction of the outlet aperture and is passed out of the tank to the heater thus spiraling the fluid around each leg as shown in FIG. 1 massaging the legs and working venous blood from them toward the heart. It will be noted that the spiral flow pattern works in combination with the effect of the extremities being raised to improve circulation to the leg and thus promotes healing .

In the varation shown in FIG. 3, fluid from the pump flows up stand pipe 44 and out openings 48 sideways against the inner sides of each leg where it is split, with a portion of it passing over the legs and a portion passing uder the legs. Again the suction of outlet aperture 28 pulls the fluid longitudinally along the legs and out of the tank. The direct impingement of the fluid against the surface of the legs provides a theraputic massaging action, however, this varation of the invention cannot be used where the skin of the leg has deteriorated to the point where direct impingement of the fluid would cause damage.

The terms and expressions which have been employed in the foregoing abstract and specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A hydrotherapy tank comprising:

(a) a tank shell having opposed sidewalls and opposed end walls interconnected by a bottom, the tank shell being adapted for holding fluid about a user's limbs, (b) one of the end walls containing paired openings for receiving the limbs of the user, (c) sealing means joined to the end wall containing the openings and arranged for sealing between the openings and the limbs against water leakage, (d) the tank bottom sloping upwardly from the end wall containing the openings in a manner for supporting the person's limbs with their extremities in an elevated condition when the limbs are inserted into the sealing means, (c) an inlet aperture located in the tank bottom between the limbs near their extremities, (d) an outlet aperture located in the tank bottom between the limbs near the openings, and (e) circulation means interconnecting the inlet aperture and outlet aperture, arranged for circulating the fluid in the tank between the outlet aperture and the inlet aperture.

2. The hydrotherapy tank of claim 1 including a heater located between the inlet aperture and the outlet aperture for heating the fluid circulated by the circulation means.

3. The hydrotherapy tank of claim 1 wherein the sealing means comprises tubular flexible rubber sleeves.

4. The hydrotherapy tank of claim 1 including foot rests located on the bottom of the tank and adapted for supporting the extremities of the limbs.

5. The hydrotherapy tank of claim 1 including a deflector located in the tank shell between the limbs above the inlet aperture, the deflector configured for deflecting fluid entering the tank through the inlet aperture sideways against the side of each leg from where it is directed above and below the limbs.

* * * * *